US011224104B2

(12) United States Patent
Krattiger

(10) Patent No.: US 11,224,104 B2
(45) **Date of Patent: *Jan. 11, 2022**

(54) DYNAMIC FILTERING FOR SMOOTH DIMMING OF LIGHTS

(71) Applicant: ERP POWER, LLC, Moorpark, CA (US)

(72) Inventor: Steven C. Krattiger, Northridge, CA (US)

(73) Assignee: ERP POWER, LLC, Moorpark, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/905,438

(22) Filed: Jun. 18, 2020

(65) Prior Publication Data

US 2020/0413501 A1 Dec. 31, 2020

Related U.S. Application Data

(60) Provisional application No. 62/866,392, filed on Jun. 25, 2019.

(51) Int. Cl.
*H05B 45/325* (2020.01)
*H05B 45/14* (2020.01)

(52) U.S. Cl.
CPC ..... *H05B 45/14* (2020.01); *H05B 45/325* (2020.01)

(58) Field of Classification Search
CPC .... H05B 41/3924; H05B 45/10; H05B 45/14; H05B 45/37; H05B 45/325; H05B 47/10; H05B 47/105; Y02B 20/30; H02M 1/4208
See application file for complete search history.

(56) References Cited

U.S. PATENT DOCUMENTS

| | | | | |
|---|---|---|---|---|
| 7,667,408 | B2 * | 2/2010 | Melanson | H05B 45/37 315/209 R |
| 8,922,135 | B2 | 12/2014 | Sumitani et al. | |
| 9,736,011 | B2 * | 8/2017 | Vasudevan | G06F 13/385 |
| 10,039,171 | B1 | 7/2018 | Li et al. | |
| 2011/0043133 | A1 | 2/2011 | Van Laanen et al. | |
| 2014/0049185 | A1 | 2/2014 | Neser et al. | |
| 2015/0146461 | A1 | 5/2015 | Deng et al. | |
| 2020/0256521 | A1 | 8/2020 | Xiong et al. | |
| 2020/0413502 | A1 * | 12/2020 | Krattiger | H05B 45/14 |
| 2020/0413509 | A1 * | 12/2020 | Krattiger | H05B 45/10 |
| 2020/0413510 | A1 * | 12/2020 | Krattiger | G01R 19/16528 |
| 2020/0413511 | A1 * | 12/2020 | Krattiger | H05B 45/325 |
| 2020/0413512 | A1 * | 12/2020 | Krattiger | H05B 45/37 |

* cited by examiner

*Primary Examiner* — Haissa Philogene
(74) *Attorney, Agent, or Firm* — Lewis Roca Rothgerber Christie LLP

(57) ABSTRACT

According to some embodiments of the present disclosure, there is provided a method of controlling a power supply electrically coupled to a dimmer, the method including receiving a current sample value of a plurality of sample values corresponding to dimmer levels, determining a dynamic weight based on the current sample value, filtering the plurality of sample values based on the dynamic weight to generate a plurality of filtered values, and generating a control signal based on the filtered values for transmission to the power supply.

20 Claims, 8 Drawing Sheets

DYNAMIC FILTERING FOR SMOOTH DIMMING OF LIGHTS

CROSS-REFERENCE TO RELATED APPLICATION(S)

This application claims priority to, and the benefit of, U.S. Provisional Application No. 62/866,392 ("UTILIZING DYNAMIC FILTERING FOR SMOOTH DIMMING OF LIGHTS"), filed on Jun. 25, 2019, the entire content of which is incorporated herein by reference.

The present application is also related to U.S. patent application Ser. No. 16/905,421, entitled "MULTI-INPUT POWER SUPPLY SYSTEM AND METHOD OF USING THE SAME", filed on Jun. 18, 2020, which claims priority to and the benefit of U.S. Provisional Application No. 62/867,052 ("TRIAC DETECTION SOFTWARE"), filed on Jun. 26, 2019, the entire contents of which are incorporated herein by reference.

The present application is also related to U.S. patent application Ser. No. 16/905,407, entitled "HIGH PERFORMANCE DIMMING BASED ON DIMMER SLEW-RATE", filed on Jun. 18, 2020, which claims priority to and the benefit of U.S. Provisional Application No. 62/867,027 ("HIGH PERFORMANCE DIMMING BASED ON DIMMER SLEW-RATE"), filed on Jun. 26, 2019, the entire contents of which are incorporated herein by reference.

The present application is also related to U.S. patent application Ser. No. 16/905,501 entitled "SYSTEM AND METHOD FOR MULTI-SLOPE CONTROL OF LIGHTING INTENSITY", filed on Jun. 18, 2020, which claims priority to and the benefit of U.S. Provisional Application No. 62/867,056 ("MULTI-SLOPE TRIAC CONTROL OF LIGHTING INTENSITY"), filed on Jun. 26, 2019, the entire contents of which are incorporated herein by reference.

The present application is also related to U.S. patent application Ser. No. 16/905,461 entitled "SYSTEM AND METHOD FOR INVALID PULSE REJECTION", filed on Jun. 18, 2020, which claims priority to and the benefit of U.S. Provisional Application No. 62/866,371 ("MISSING PULSE CORRECTION FOR PROGRAMMABLE TRIAC CONTROL DRIVERS"), filed on Jun. 25, 2019, the entire contents of which are incorporated herein by reference.

The present application is also related to U.S. patent application Ser. No. 16/905,516, entitled "MOVEMENT-BASED DYNAMIC FILTERING FOR SMOOTH DIMMING OF LIGHTS", filed on Jun. 18, 2020, which claims priority to and the benefit of U.S. Provisional Application No. 62/866,392 ("UTILIZING DYNAMIC FILTERING FOR SMOOTH DIMMING OF LIGHTS"), filed on Jun. 25, 2019, the entire contents of which are incorporated herein by reference.

FIELD

Aspects of the present disclosure are related to a system for enhanced light dimming and a method for using the same.

BACKGROUND

All traditional light dimmers produce a certain amount of electrical noise. Noise that is present in the input signal of an incandescent, a fluorescent, or a halogen light, is generally not perceptible. However, due to the high-responsivity of LEDs, any input noise may cause flickering in the LED output of a power-supply.

The above information disclosed in this Background section is only for enhancement of understanding of the disclosure, and therefore it may contain information that does not form the prior art that is already known to a person of ordinary skill in the art.

SUMMARY

Aspects of embodiments of the present disclosure are directed to enhanced dimming and stability of power-supply products utilized in lighting systems.

Aspects of embodiments of the present disclosure are directed to a power supply system utilizing a dynamic filter that eliminates or substantially reduces noise. In some embodiments, the power supply system actively modifies the depth of the filter to enhance or eliminate filtering as the light dimmer is adjusted. To effectively use the limited amount of memory and processing power offered by the microprocessor, some embodiments of the present disclosure use two storage locations, and perform a reduced and fixed number of operations for each iteration of the filter, irrespective of the depth of the filter. Further, the dynamic filter according to some embodiments of the present disclosure can be changed to adapt to instantaneous user input, and can be used with analog 0 V-10 V and phase-cut TRIAC dimmers.

According to some embodiments of the present disclosure, there is provided a method of controlling a power supply electrically coupled to a dimmer, the method including: receiving a current sample value of a plurality of sample values corresponding to dimmer levels; determining a dynamic weight based on the current sample value; filtering the plurality of sample values based on the dynamic weight to generate a plurality of filtered values; and generating a control signal based on the filtered values for transmission to the power supply.

In some embodiments, the method further includes: receiving a modified AC input signal from the dimmer; and generating a PWM signal based on the modified AC input signal, the PWM signal including a plurality of PWM pulses, wherein a duty cycle of a current PWM pulse of the plurality of PWM pulses corresponds to a current dimmer level of the dimmer.

In some embodiments, the method further includes: generating the plurality of sample values based on the plurality of PWM pulses.

In some embodiments, the determining the dynamic weight includes: determining that the current sample value is greater than a threshold value; and in response, setting the dynamic weight to a high value.

In some embodiments, the threshold value is 15% of a maximum sample value range to 30% of the maximum sample value range, and the high value is 5% to 10% of a number of samples utilized in filtering the sample value.

In some embodiments, the determining the dynamic weight includes: determining that the current sample value is less than or equal to a threshold value; and in response, setting the dynamic weight to a low value.

In some embodiments, the threshold value is 15% of a maximum sample value range to 30% of the maximum sample value range, and the low value is 0.1% to 1% of a number of samples utilized in filtering the sample value.

In some embodiments, the determining the dynamic weight includes: setting the dynamic weight to a value proportional to the current sample value.

In some embodiments, the filtering the plurality of sample values includes: determining a current filtered value of the plurality of filtered values based on the dynamic weight, the current sample value, and a previous filtered value of the plurality of filtered values.

In some embodiments, the filtering the plurality of sample values includes: determining an i-th filtered value FilteredValue(i) of the plurality of filtered values (where i is an integer greater than 1) as $$FilteredValue(i) = \frac{\beta \times \text{sample}(i) + (\text{max_samples} - \beta) \times FilteredValue(i-1)}{\text{max_samples}}$$

where β represents the dynamic weight, sample(i) is an i-th sample value of the plurality of sample values, max_samples is a maximum number of sample values utilized in the filtering of the plurality of sample values, and FilteredValue(i−1) is an (i−1)-th filtered value of the of the plurality of filtered values.

In some embodiments, the power supply is electrically coupled to an LED light and is configured to control light intensity of the LED light based on the control signal.

According to some embodiments of the present disclosure, there is provided a power supply controller coupled to a power supply, the power supply controller including: a processor; and a processor memory local to the processor, wherein the processor memory has stored thereon instructions that, when executed by the processor, cause the processor to perform: receiving a current sample value of a plurality of sample values corresponding to dimmer levels; determining a dynamic weight based on the current sample value; filtering the plurality of sample values based on the dynamic weight to generate a plurality of filtered values; and generating a control signal based on the filtered values for transmission to the power supply.

In some embodiments, the power supply is electrically coupled to an LED light and is configured to control light intensity of the LED light based on the control signal.

In some embodiments, the determining the dynamic weight includes: determining that the current sample value is greater than a threshold value; and in response, setting the dynamic weight to a high value.

In some embodiments, the determining the dynamic weight includes: determining that the current sample value is less than or equal to a threshold value; and in response, setting the dynamic weight to a low value.

In some embodiments, the determining the dynamic weight includes: setting the dynamic weight to a value proportional to the current sample value.

In some embodiments, the filtering the plurality of sample values includes: determining a current filtered value of the plurality of filtered values based on the dynamic weight, the current sample value, and a previous filtered value of the plurality of filtered values.

In some embodiments, the filtering the plurality of sample values includes:

determining an i-th filtered value FilteredValue(i) of the plurality of filtered values (where i is an integer greater than 1) as $$FilteredValue(i) = \frac{\beta \times \text{sample}(i) + (\text{max_samples} - \beta) \times FilteredValue(i-1)}{\text{max_samples}}$$

where β represents the dynamic weight, sample(i) is an i-th sample value of the plurality of sample values, max_samples is a maximum number of sample values utilized in the filtering of the plurality of sample values, and FilteredValue(i−1) is an (i−1)-th filtered value of the of the plurality of filtered values.

In some embodiments, the filtering the plurality of sample values includes: determining a current filtered value of the plurality of filtered values based on the dynamic weight, the current sample value, and a previous filtered value of the plurality of filtered values.

In some embodiments, the power supply is configured to drive a light source based on the control signal.

BRIEF DESCRIPTION OF THE DRAWINGS

The accompanying drawings, together with the specification, illustrate example embodiments of the present disclosure, and, together with the description, serve to explain the principles of the present disclosure.

DETAILED DESCRIPTION

The detailed description set forth below is intended as a description of example embodiments of a system and method for input noise reduction in LED lighting, provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the spirit and scope of the disclosure. As denoted elsewhere herein, like element numbers are intended to indicate like elements or features.

Light dimmers have been on the market for many years, and have traditionally been used for dimming incandescent, fluorescent, and halogen lights. Dimmer switches designed for these other types of lighting aren't necessarily compatible with LED lighting. These traditional dimmers may have a certain amount of noise on the analog dimming signal that may cause flickering when driving LED lighting.

To overcome this noise, filtering may be utilized within the power-supply. However, with filtering added, the input dimmer switch may appear to be sluggish, or non-responsive. Further, averaging filters may be memory and computationally expensive. For example, conventional averaging filters involve the storage and calculation of N past samples ($x_1, x_2, \ldots x_N$) and performing one division, as shown by Equation (1):

$$\text{average} = \frac{x_1 + x_2 + x_3 + \ldots x_N}{N} \qquad \text{Equation (1)}$$

In practice, this type of filter requires the use of a memory (e.g., a circular memory) with sufficient storage capacity to store the last N samples, and with one or more memory pointers to bring in a new sample and eliminate the oldest. Performing the operation of Equation 1 also involves a large number of additions and a division for each successive sample. For example, averaging 1000 samples involves 1001 mathematical computations per average calculation.

According to some embodiments of the present disclosure, the power supply system utilizes a memory-and-processor-efficient dynamic filter to filter or average out noise on the input signal so that the output remains substantially constant, and thus resistant to flickering.

Figure 1:
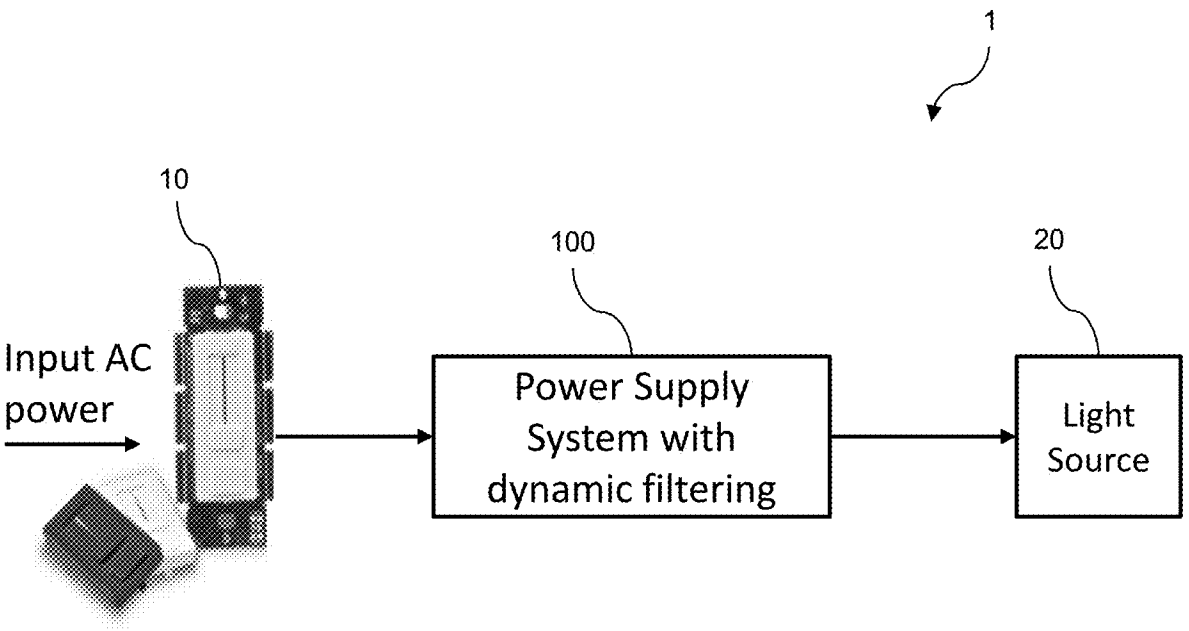
FIG. 1 is a block diagram of a lighting system utilizing the power supply system, according to some embodiments of the present disclosure.

FIG. 1 is a block diagram of a lighting system 1 utilizing the power supply system 100, according to some embodiments of the present disclosure.

Referring to FIG. 1, lighting system 1 includes a dimmer (e.g., a phase dimmer) 10, the power supply system 100, and a light source 20. According to some examples, the dimmer interface may be a rocker interface, a tap interface, a slide interface, a rotary interface, or the like. A user may adjust the dimmer level by, for example, adjusting a position of a dimmer lever or a rotation of a rotary dimmer knob, or the like. The dimmer 10 receives an AC input signal (e.g., a 120 V AC signal from the wall) and modifies (e.g., cuts/chops a portion of) the AC input voltage sinewave signal according to the dimmer level before sending it to the power supply system 100, and thus variably reduces the electrical power delivered to the power supply system 100. The power supply system 100 in turn produces a drive signal (e.g., an output current or voltage) that is proportional to the reduced power provided by the dimmer 10 and provides the drive signal to the light source 20. Thus, the light output of the light source 20 may be proportional to the phase angle of the modified sine wave. This results in the dimming of the light output. In some examples, the dimmer 10 may be a TRIAC or ELV dimmer, and may chop the front end or leading edge of the AC input signal. The light source 20 may include one or more light-emitting-diodes (LEDs). In some embodiments, the power supply system 100 is also configured to dynamically filter the modified input signal received from the dimmer 10 to reduce or eliminate input noise, while being highly responsive to changes in the dimmer level.

Figure 2:
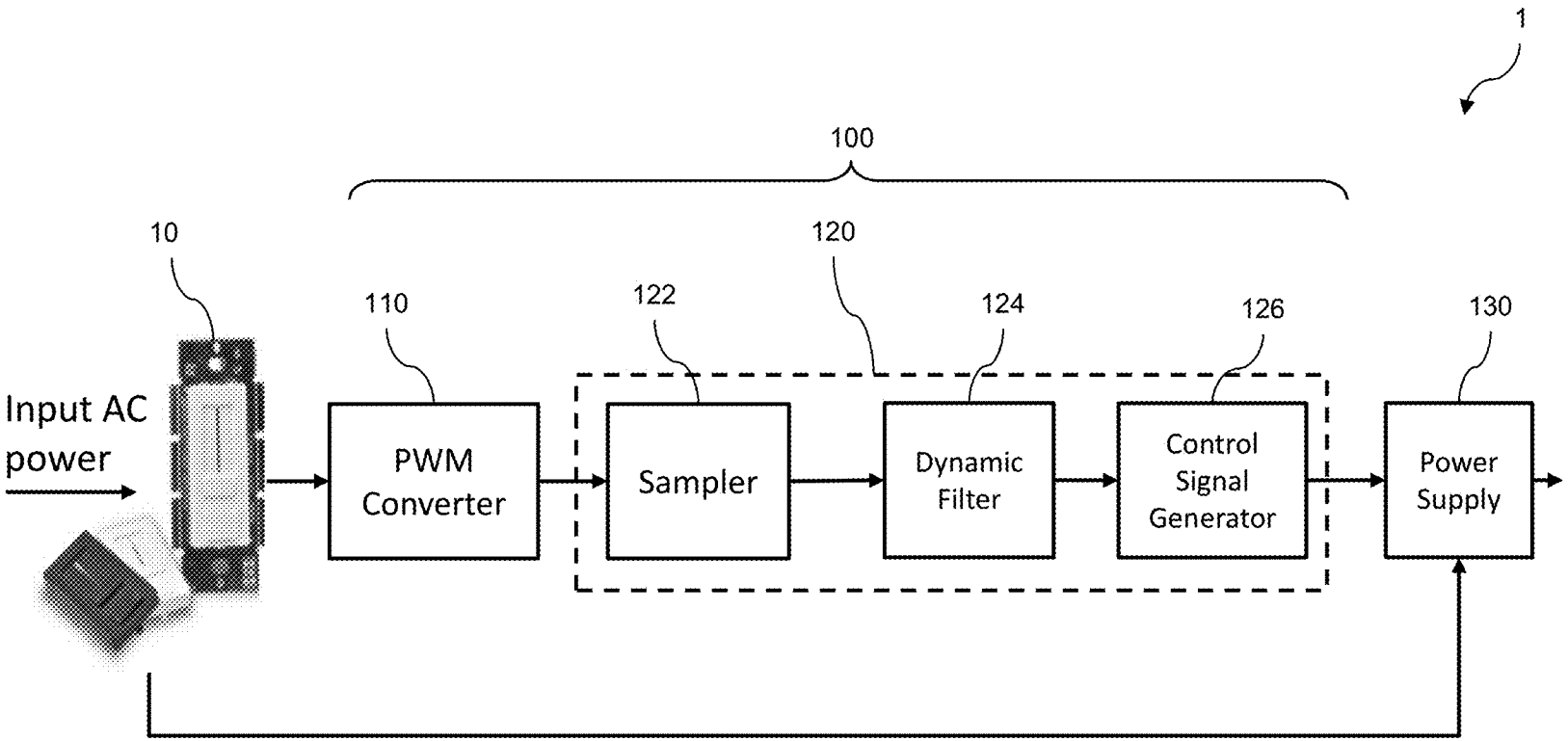
FIG. 2 is a block diagram of the power supply system within the lighting system, according to some embodiments of the present disclosure.

FIG. 2 is a block diagram of the power supply system 100 within the lighting system 1, according to some embodiments of the present disclosure.

Referring to FIG. 2, the power supply system 100 includes a PWM converter 110, a power supply controller 120, and a power supply 130.

The PWM converter 110 is configured to convert the modified AC input signal received from the dimmer 10 into a pulse width modulation (PWM) signal for processing by the power supply controller 120. The PWM converter 110 may include one or more comparators that compare the positive and negative swings of the incoming modified AC input signal with one or more set or predefined thresholds to generate a corresponding PWM signal. Thus, the PWM converter 110 maps the dimmed power of the modified AC input signal to pulse width modulations of the PWM signal. In some examples, the duty cycle of the PWM signal represents the dimmer level (i.e., the user setting at the dimmer 10). In some examples, a high value in the PWM signal may be about 3.3 V, which may correspond to a logic high (or a binary '1'), and a low value may be about 0 V, which may correspond to a logic low (or binary '0).

In some embodiments, the power supply controller 120 is configured to measure (e.g., continuously measure) the duty cycle of the PWM signal and to generate a sequence of sample values, which may correspond to the dimming levels of the dimmer 10 at a plurality of sample times. The power supply controller 120 detects changes in the dimmer level based on the sequence of samples, and dynamically filters the sampled values based on the detected change to generate a control signal that is provided to the power supply 130.

The power supply 130 in turn generates a drive signal based on the control signal for powering and controlling the brightness of the light source 20. The drive signal may depend on the type of the one or more LEDs of the light source 20. For example, when the one or more LEDs of the light source 20 are constant current LEDs the drive signal may be a variable voltage signal, and when the light source 20 requires constant voltage, the drive signal may be a variable current signal. The power supply 130 may receive its input power from the modified AC signal from the dimmer 10.

According to some embodiments, the power supply controller 120 includes a sampler 122, a dynamic filter 124, and a control signal generator 126. The sampler 122 measures the duty cycle of each PWM pulse of the received the PWM signal to determine the dimmer level of the dimmer 10 at regular intervals, and generates a plurality of sample values corresponding to the duty cycle of the PWM pulses. Each sample value may be a value between 0, which may indicate a 0% duty cycle for a corresponding PWM pulse, and a maximum value, which may indicate a 100% duty cycle for the corresponding PWM pulse. As such, a value of zero may correspond to a minimum brightness setting (e.g., 0% brightness setting) at the dimmer 10, which may indicate, e.g., a user's desire to turn the light source 20 completely off. Further, the maximum value (e.g., 1000 or 10000) may correspond to a maximum brightness setting (e.g., 100% brightness setting) at the dimmer 10, which may indicate, e.g., a user's desire to turn the light source 20 fully on. In other words, each sample value corresponds to a new target setting that a light source 20 should output. The sampling frequency of the sampler 122 may be significantly faster than the speed at which a user can change the dimmer level. For example, the sampling frequency may be about 12 kHz or higher.

According to some embodiments, the dynamic filter 124 is configured to dynamically filter (e.g., recursively filter) the sequence of samples produced by the sampler 122 based on the dimmer level, which is represented by current sample value. The dynamic filter 124 may dynamically adjust the filtered output (that defines the control signal) to be more or less responsive to the modified AC signal of the dimmer 10 depending on the dimmer level (e.g., depending on the position of a dimmer lever).

In some embodiments, the dynamic filter 124 receives a plurality of sample values {sample (1) . . . sample(N)} from the sampler 122 and generates a corresponding set of filtered values {FilteredValue(1) FilteredValue(N)}. The dynamic filter 124 calculates each filtered value FilteredValue(i) (where i is an integer greater than 1) based on a previous filtered value FilteredValue(i−1), which is stored in memory, and a dynamic weight, which is adjusted by the dynamic filter 124 based on the dimmer level. In the filtering operation performed by the dynamic filter 124, each new sample value becomes a small part of the original value, averaged into the new output value.

According to some embodiments, the dynamic filter 124 of the power supply controller 120 is configured to determine the i-th filtered value FilteredValue(i) of the filtered signal as:

$$FilteredValue(i) = \frac{\beta \times \text{sample}(i) + (\text{max_samples} - \beta) \times FilteredValue(i-1)}{\text{max_samples}} \quad \text{Equation (2)}$$

where β represents the dynamic weight of the i-th sample of the input signal sample(i), max_samples is a maximum number of sample values utilized in the filtering of the plurality of sample values, and FilteredValue(i−1) is the (i−1)-th filtered value of the filtered signal. The number of samples max_samples may be any suitable value, for example, 100, 1000, or the like. Higher max_samples values provide more resolution to the dynamic filter 124, which in turn makes the stepped changes in the dynamic weight from one value to the next less noticeable (i.e., the change in filtered output may be smoother when the dynamic weight is step-changed).

Thus, according to some embodiments, the dynamic filter 124 performs an averaging operation that utilizes a single storage location for storing the current value of the filtered value and five math functions, thus significantly reducing (e.g., minimizing) the storage and computation time required for any depth of averaging (i.e., any number of samples being averaged). In some embodiments, averaging of any depth (i.e., any number of samples) utilizes two multiplications, one addition, one subtraction, and one division. This is in contrast to standard averaging techniques in which a number of samples equal to the filter depth are stored in memory, and the number of operations performed to achieve averaging is greater than the filter depth.

Further, by dynamically adjusting/modulating the dynamic weight, the dynamic filter 124 can impact how responsive the filtered value (and thus the power supply control signal) is to the modified AC signal of the dimmer 10. For example, with max_samples=1000, and the β=50, each iteration of the filter results in 50-parts of the new sample averaged in with 950-parts of the prior filtered value, which makes the current filtered value highly responsive to, and influenced by, the current sample value of the input signal. By setting β=1, each new sample represents a weight of 1/1000, or a slowly responsive 0.1% weighting.

Figure 3:
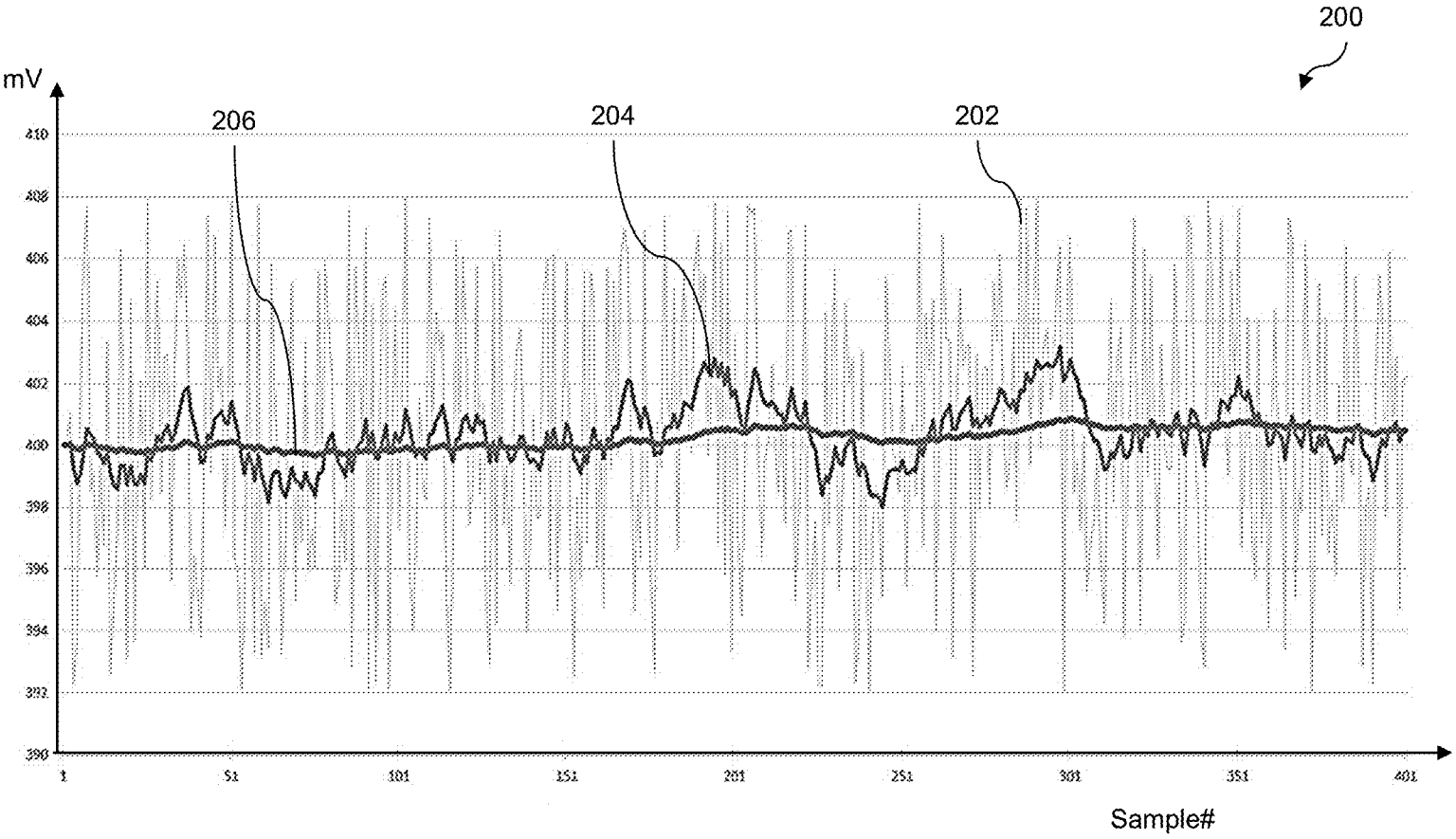
FIG. 3 is a graph illustrating the effect of different dynamic weights on the filtering operation of the power supply controller, according to some example embodiments of the present disclosure.

FIG. 3 is a graph 200 illustrating the effect of different dynamic weights on the filtering operation of the power supply controller 120, according to some example embodiments of the present disclosure.

In the example of FIG. 3, the sample values 202 received by the dynamic filter exhibit a noise of about +/−2% noise over a 400 mV signal. With a high dynamic weight of about 100, the filtered values 204 are more response to the input sample values 202 and thus exhibit some level of noise. However, with a low dynamic weight of about 10, the filtered value 206 are less response to the input sample values 202 and thus exhibit a low level of noise. Thus, the level of noise in the filtered signal decreases as the dynamic weight is reduced.

According to some examples, the modified AC signal received from the dimmer 10 is noisier at low dimmer levels (e.g., at 10% dimmer setting) than at high dimmer levels (e.g., at 90% dimmer setting). In the example of triac dimmers that chop the AC signal from the wall, most of the AC signal is chopped at low dimmer settings, and very little of the AC sine wave remains. Thus, any error in the chopping operations of the triac dimmer may result in noticeable jitters in the PWM pulses generated by the PWM converter 110. Any chopping error may be less noticeable at higher dimmer settings, as most of the power in the AC signal is still present in the modified/chopped AC signal. As such, more noise may be present in low sample values than in high sample values. Thus, the dynamic filter 124 may track the sample values and adjust the dynamic weight accordingly.

In some embodiments, when the dynamic filter 124 detects a sample value that is above a threshold value (corresponding to a high dimmer level), the dynamic filter 124 sets the dynamic weight to a high value and thus generates a filtered output that is highly responsive to (e.g., that can quickly track) changes in dimmer level, and when dynamic filter 124 detects a sample value that is at or below the threshold value (corresponding to a low dimmer level), the dynamic filter 124 sets the dynamic weight to a low value and thus generates a filtered output that is more resistant to change and reduces or eliminated input noise. In some examples, the threshold value is about 15% of the maximum sample value range (e.g., 10000) to about 30% of the maximum sample value range (e.g., 20% of the maximum sample value range). Further, the low value for the dynamic weight may be about 0.1% to about 1% of the number of samples max_samples utilized by the dynamic filter 124, and the high value for the dynamic weight may be about 5% to about 10% of the number of samples max_samples. In examples in which the dynamic filter 124 utilizes a 1000 samples, the low value may be about 1 to about 10, and the high value may be about 50 to about 100. However, embodiments of the present disclosure are not limited to a binary setting for the dynamic weight, and in some examples, the dynamic weight may be changed gradually as the sample values increase or decrease.

According to some embodiments, the dynamic filter 124 sets the value of the dynamic weight to be proportional (e.g., linearly proportional) to the current sample value. For example, as the sample value changes from a minimum value (e.g., 0) to a maximum value (e.g., 10000), the dynamic weight may proportionally change from a lowest value (e.g., 0.1% of max_samples) to a highest value (e.g., 10% of max_samples).

In some examples, the change in the dynamic weight may S-curve type relationship with the sample values. That is, as the sample values increase, the dynamic value raises slowly from a lowest value (e.g., 1-5), the rate of change of the dynamic weight increases as the sample value are in the mid-range, and tapers off toward a highest value (e.g., 50-100) as the sample values get closer to the maximum value.

Figure 4A:
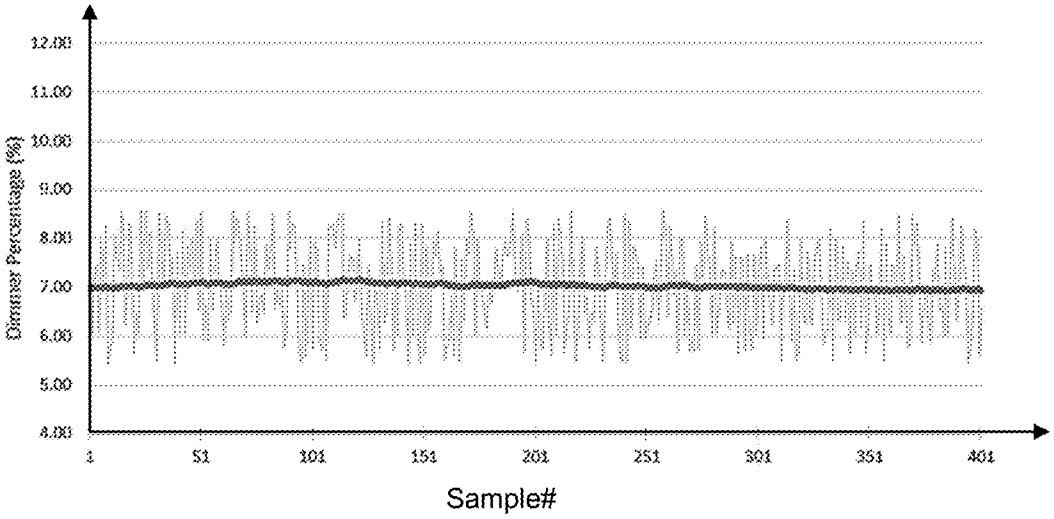
FIGS. 4A-4B are graphs illustrating the effects of a low dynamic weight at a low dimmer level setting and a high dynamic weight at a high dimmer level setting, respectively, according to some embodiments of the present disclosure.
Figure 4B:
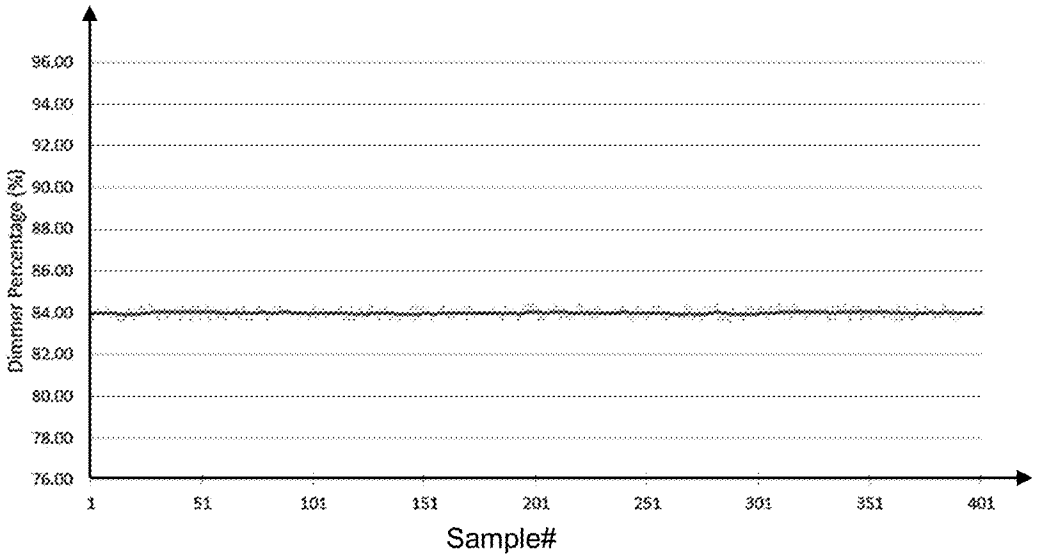

FIGS. 4A-4B are graphs illustrating the effects of a low dynamic weight at a low dimmer level setting and a high dynamic weight at a high dimmer level setting, respectively, according to some embodiments of the present disclosure.

In the example of FIG. 4A, the dimmer level is set to a low level of about 7% and the sample values received by the dynamic filter are quite noisy. However, by setting the dynamic weight to a low value of 10 (with max_samples=1000), most of the noise is filtered by the dynamic filter 124 and the resulting filtered signal exhibits relatively low noise. In the example of FIG. 4B, the dimmer level is set to a high level of about 84% and the sample values received by the dynamic filter exhibit little noise. Thus, even by setting the dynamic weight to a high value of 60 (with max_samples=1000), the dynamic filter 124 is capable of producing a relatively stable output.

Embodiments of the present disclosure are not limited to setting the dynamic weight according to dimmer level, and in some embodiments, the dynamic weight is dependent on the movement of the dimmer.

Figure 5:
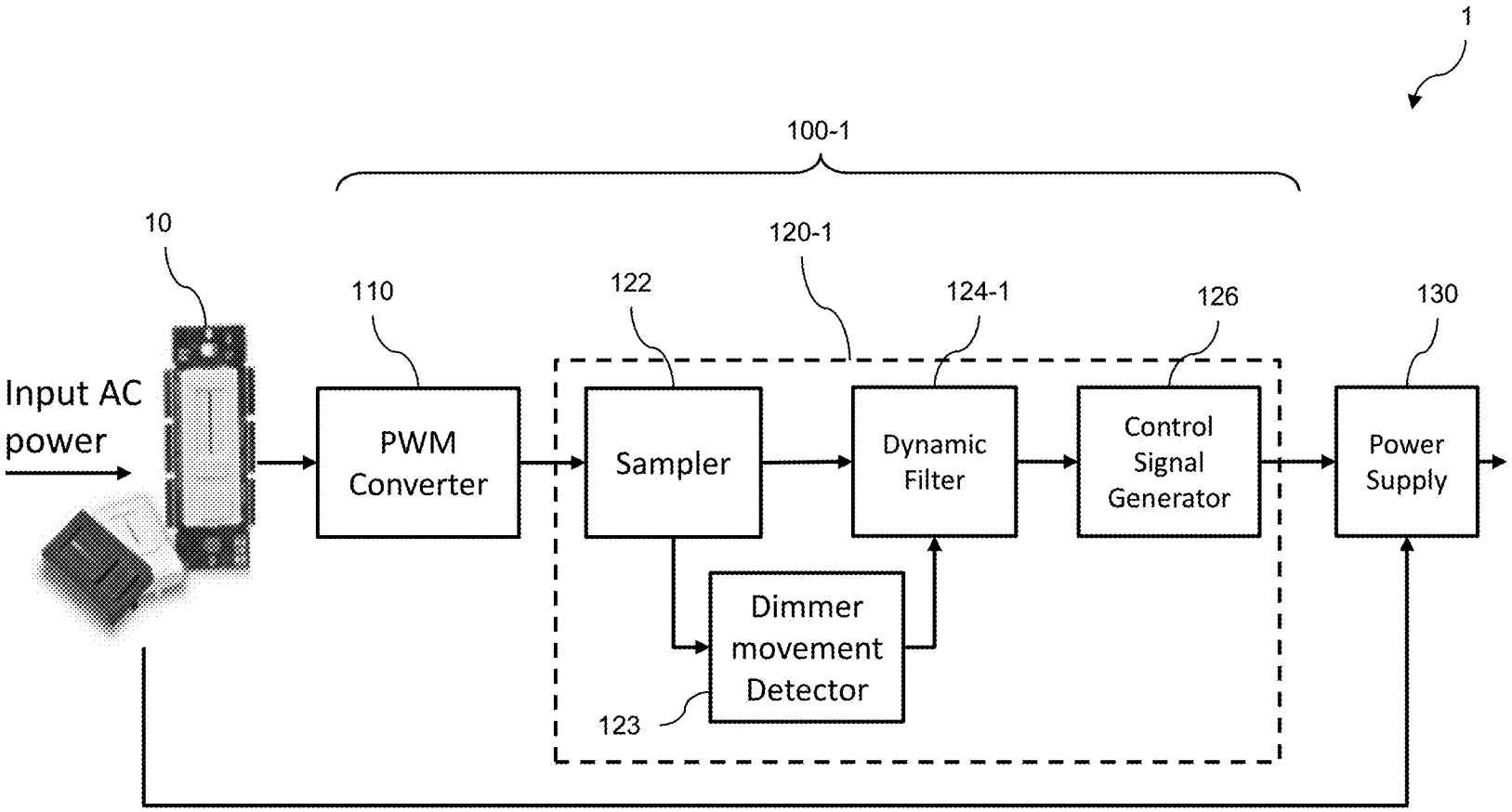
FIG. 5 is a block diagram of the power supply system within the lighting system 1, which utilizes movement-based dynamic filtering, according to some embodiments of the present disclosure.

FIG. 5 is a block diagram of the power supply system 100-1 within the lighting system 1, which utilizes movement-based dynamic filtering, according to some embodiments of the present disclosure. The power supply system 100-1 of FIG. 5 is substantially the same as the power supply system 100 of FIG. 2, except that the power supply controller 120-1 adjusts the dynamic weight based on dimmer level movement. For purposes of brevity, descriptions of the elements and processes that are common between the power supply controllers 120 and 120-1 may not be repeated herein.

According to some embodiments, the power supply controller 120-1 includes a dimmer movement detector 123, which monitors the sample values produced by the sampler 122 to determine if there is movement in the dimmer level and signals the dynamic filter 124 accordingly. The dynamic filter 124 then adjusts the dynamic weight based on movement of the dimmer level or lack thereof. In some embodiments, when movement is detected, the dynamic filter 124 sets the dynamic weight to a high value (e.g., 50, 60, or 100) to accurately track the user's movement of the dimmer 10 in real-time. In the absence of movement, the dynamic filter 124 gradually (e.g., linearly) reduces the dynamic weight to the low value (e.g., 1) at a particular rate. The dynamic weight may remain at the low value until a change is detected in the dimmer level. This allows the power supply controller 120 to quickly react to user input in real-time, and once the desired intensity is set, the power supply controller 120 gradually becomes more resilient to noise and dimmer movements.

Figure 6A:
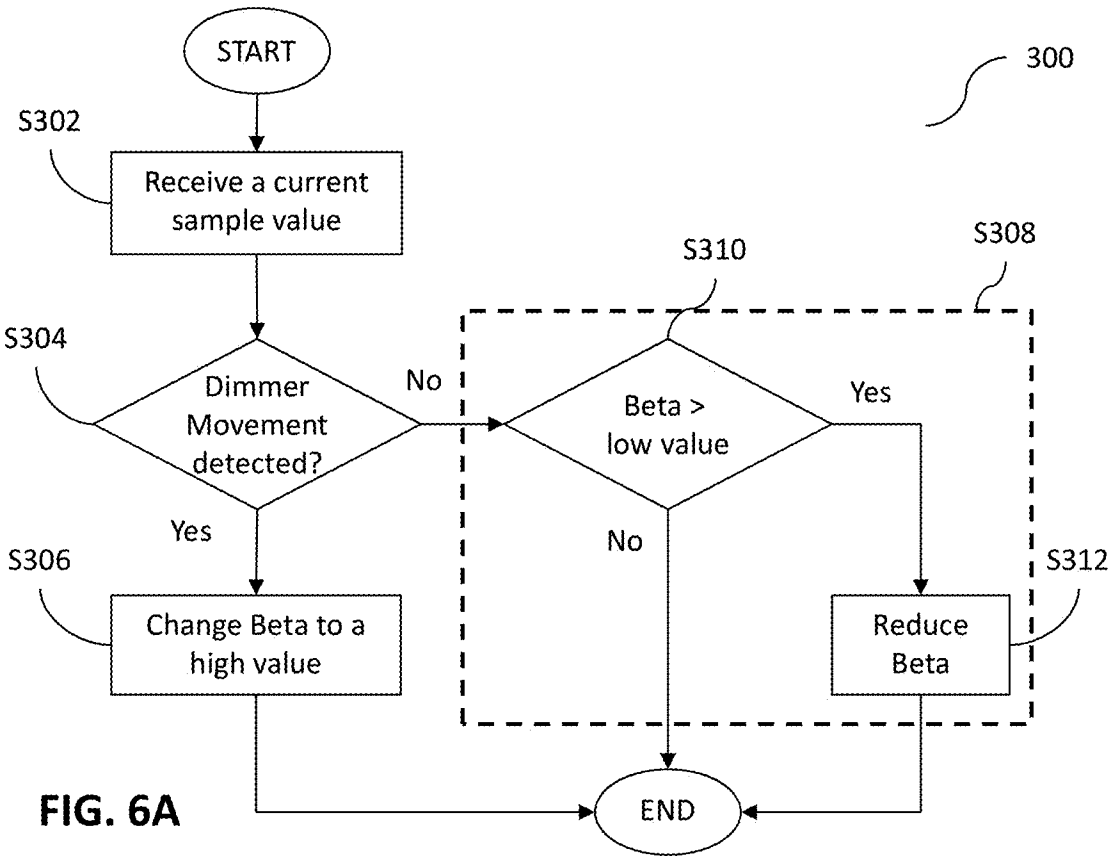
FIGS. 6A-6B are flow diagrams illustrating the process of controlling the power supply based on dimmer level movement detection, according to some embodiments of the present disclosure.
Figure 6B:
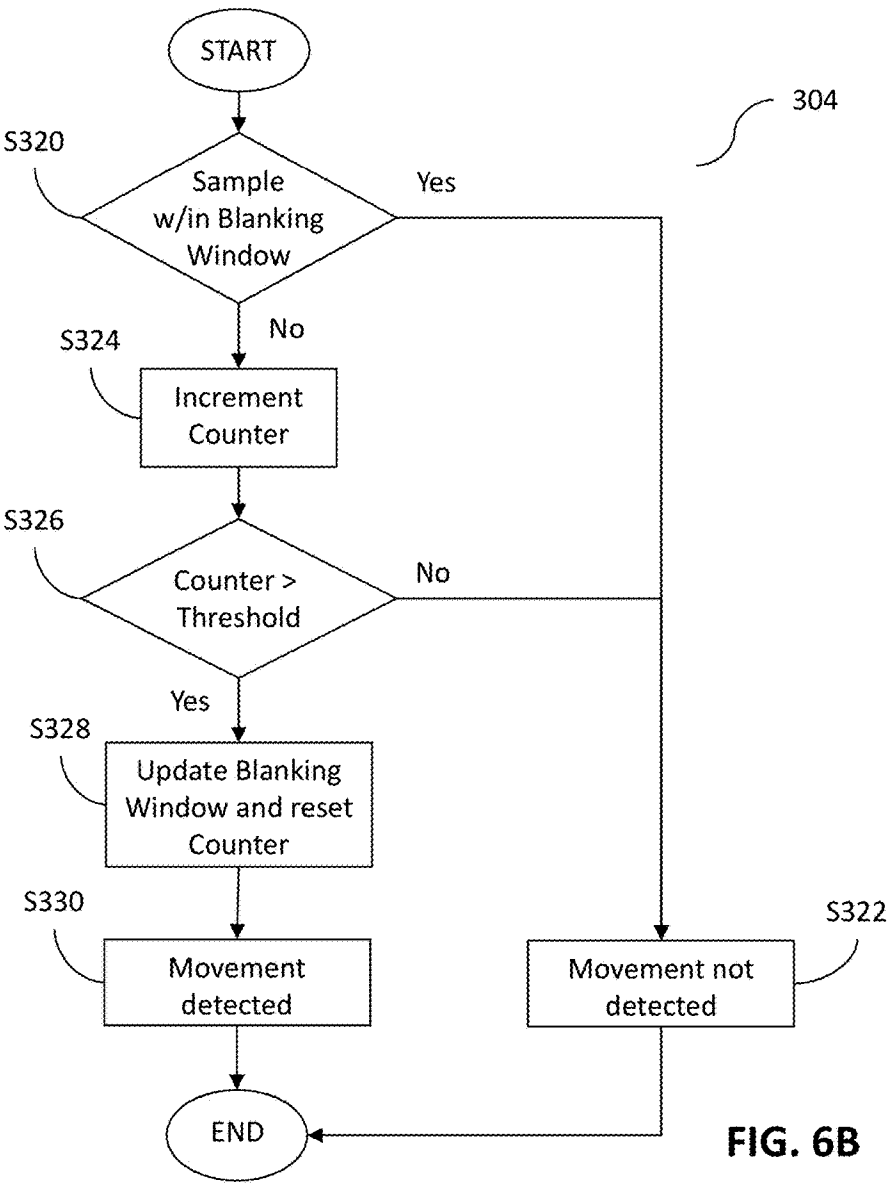

FIGS. 6A-6B are flow diagrams illustrating the process 300 of controlling the power supply 130 based on dimmer level movement detection, according to some embodiments of the present disclosure.

Referring to FIG. 6A, in some embodiments, the power supply controller 120-1 (e.g., the sampler 122) generates a plurality of sample value based on a plurality of PWM pulses received from the PWM converter 110 (S302). The power supply controller 120-1 (e.g., the dimmer movement detector 123) then determines whether there is any change/movement in the dimmer levels (e.g., as a result of a user moving a dimmer lever) (S304). If dimmer movement is detected, the power supply controller 120-1 changes the dynamic weight to a high value (e.g., 50 to 100) (S306), and if no movement is detected, reduces the dynamic weight toward a low value (e.g., 1-10) (S308), and proceeds to filter the sample values. In reducing the dynamic weight, the power supply controller 120-1 first determines whether the dynamic weight is above the low value (S310), and if it is, reduces the dynamic weight by a set value (S312) at regular intervals. In some examples, the dynamic weight may be decremented by one every 50 mS until the low value is reached. Thus, it may take about 5 seconds for the dynamic weight to decrease from a high value of 100 to a low value of 1 to achieve maximum noise rejection. Once the dynamic weight reaches the low value, no further reductions are done.

The power supply controller 120-1 filters each sample value and generates a corresponding filtered value that is based on the current sample value, the dynamic weight corresponding to the sample value, and the previous filtered value. In some embodiments, each filtered value is calculated according to Equation (2).

Referring now to FIG. 6B, the power supply controller 120-1 (e.g., the dimmer movement detector 123) determines whether there is any change/movement in the dimmer levels by first determining whether the current sample value falls within a blanking window (S320). The blanking window may be a range of values from a negative tolerance to a positive tolerance of a previous sample value of the plurality of sample values. According to some examples, the negative tolerance may be about −2% to about −5% of a previous sample value used to establish the blanking window, and the positive tolerance may be about 2% to about 5% of the previous sample value. When the current sample value is within the blanking window, the slight change in sample values may be a result of noise and not a real change in dimmer levels. As such, the power supply controller 120-1 determines that no movement has been detected (S322).

When the current sample value is not within the blanking window, the change in sample values may be indicative of a real change in the dimmer level or may be a result of noise. As such, the power supply controller 120-1 maintains a counter of sample values that fall outside of the blanking window to determine if the change is instantaneous noise or part of a real trend. Accordingly, when a current sample value is outside of the blanking window, the power supply controller 120-1 increments the counter (S324) and checks whether the counter is greater than a counter threshold (S326), which may be a value from 3 to 10, for example. If the counter threshold has not been exceeded, the power supply controller 120-1 determines that no movement has been detected (S322). However, when the counter threshold has been exceeded, a sufficient number of sample values have fallen outside of the blanking window to indicate that the dimmer level has actually moved. As a result, the power supply controller 120-1, updates the blanking window based on the current sample, resets the counter (e.g., to zero) (S328) and makes the determination that there is movement in the dimmer level (S330). Here, updating the blanking window includes setting the blanking window as a range of values from the negative tolerance of the current sample value to the positive tolerance of the current sample value.

According to some embodiments, the power supply controller 120 performs the processes described with respect to FIGS. 6A-6B for every new sample value. In other words, the processes of FIGS. 6A-6B are continuously looped for each incoming PWM pulse received from the PWM converter 110.

As described herein, the power supply system is capable of dynamically filtering an input signal from a dimmer to produce an output that is substantially noise and flicker free. The dynamic filter may become more or less responsive to the input based on the dimmer level or movement of the dimmer level. In some embodiments, the power supply system utilizes a memory-and-processor-efficient dynamic filter that reduces (e.g., minimizes) the amount of memory and processing power used by the filtering process.

According to some embodiments, the power supply controller 120/120-1 includes any combination of hardware, firmware, or software, employed to process data or digital signals. This may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In the power supply controller 120/120-1, each function may be performed either by hardware configured, i.e., hard-wired, to perform that function, or by more general purpose hardware, such as a CPU, configured to execute instructions stored in a non-transitory storage medium. The power supply controller 120/120-1 may be fabricated on a single printed wiring board (PWB) or distributed over several interconnected PWBs.

Figure 7:
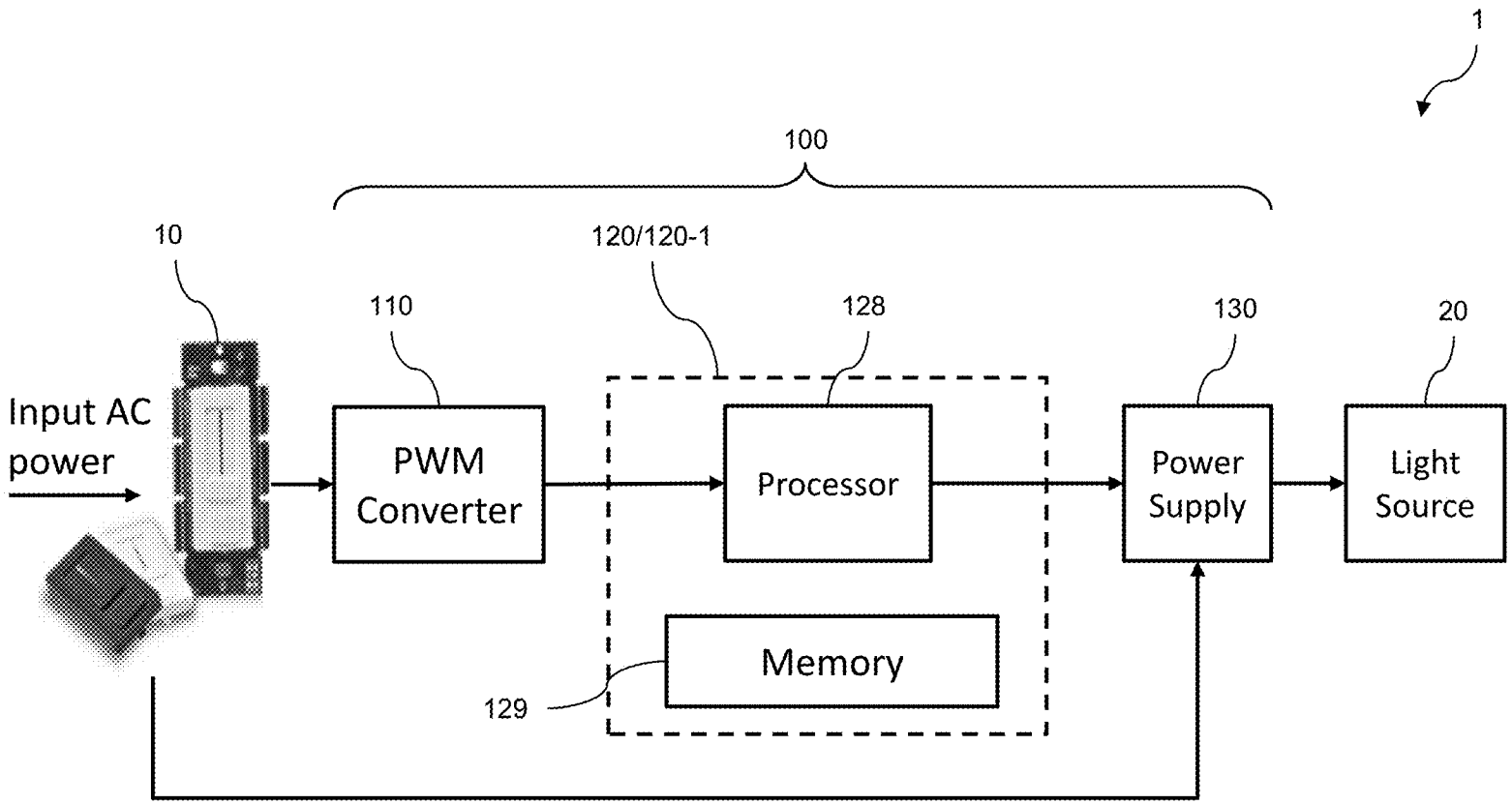
FIG. 7 is a block diagram illustrating the power supply controller implemented as a processor and memory, according to some embodiments of the present disclosure.

FIG. 7 is a block diagram illustrating the power supply controller implemented as a processor and memory, according to some embodiments of the present disclosure.

As shown in FIG. 7, in some embodiments, the power supply controller 120/120-1 includes a processor 128 and a memory 128. The processor 128 may include, for example, one or more application specific integrated circuits (ASICs), general purpose or special purpose central processing units (CPUs), digital signal processors (DSPs), graphics processing units (GPUs), and programmable logic devices such as field programmable gate arrays (FPGAs). The memory 128 may have instructions stored thereon that, when executed by the processor 128, cause the processor 128 to perform the operations of the sampler 122, the dynamic filter 124/124-1, the control signal generator 126, and in some embodiments, the dimmer movement detector 123.

It will be understood that, although the terms "first", "second", "third", etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include", "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of", when preceding a list of elements, modify the entire list of elements and do not modify the individual elements of the list. Further, the use of "may" when describing embodiments of the inventive concept refers to "one or more embodiments of the inventive concept". Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the terms "substantially", "about", and similar terms are used as terms of approximation and not as terms of degree, and are intended to account for the inherent variations in measured or calculated values that would be recognized by those of ordinary skill in the art.

As used herein, the terms "use", "using", and "used" may be considered synonymous with the terms "utilize", "utilizing", and "utilized", respectively.

The various components of the power supply system may be formed on one integrated circuit (IC) chip or on separate IC chips. Further, the various components of the power supply system may be implemented on a flexible printed circuit film, a tape carrier package (TCP), a printed circuit board (PCB), or formed on the same substrate. Further, the various components of the power supply system may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). Also, a person of skill in the art should recognize that the functionality of various computing devices may be combined or integrated into a single computing device, or the functionality of a particular computing device may be distributed across one or more other computing devices without departing from the scope of the exemplary embodiments of the present disclosure.

While this disclosure has been described in detail with particular references to illustrative embodiments thereof, the embodiments described herein are not intended to be exhaustive or to limit the scope of the disclosure to the exact forms disclosed. Persons skilled in the art and technology to which this disclosure pertains will appreciate that alterations and changes in the described structures and methods of assembly and operation can be practiced without meaningfully departing from the principles, spirit, and scope of this disclosure, as set forth in the following claims and equivalents thereof.

What is claimed is:

1. A method of controlling a power supply electrically coupled to a dimmer, the method comprising:

receiving a current sample value of a plurality of sample values corresponding to dimmer levels;

determining a dynamic weight based on the current sample value;

filtering the plurality of sample values based on the dynamic weight to generate a plurality of filtered values; and generating a control signal based on the filtered values for transmission to the power supply.

2. The method of claim 1, further comprising:

receiving a modified AC input signal from the dimmer; and generating a PWM signal based on the modified AC input signal, the PWM signal comprising a plurality of PWM pulses, wherein a duty cycle of a current PWM pulse of the plurality of PWM pulses corresponds to a current dimmer level of the dimmer.

3. The method of claim 2, further comprising:

generating the plurality of sample values based on the plurality of PWM pulses.

4. The method of claim 1, wherein the determining the dynamic weight comprises:

determining that the current sample value is greater than a threshold value; and in response, setting the dynamic weight to a high value.

5. The method of claim 4, wherein the threshold value is 15% of a maximum sample value range to 30% of the maximum sample value range, and wherein the high value is 5% to 10% of a number of samples utilized in filtering the plurality of sample values.

6. The method of claim 1, wherein the determining the dynamic weight comprises:

determining that the current sample value is less than or equal to a threshold value; and in response, setting the dynamic weight to a low value.

7. The method of claim 6, wherein the threshold value is 15% of a maximum sample value range to 30% of the maximum sample value range, and wherein the low value is 0.1% to 1% of a number of samples utilized in filtering the plurality of sample values.

8. The method of claim 1, wherein the determining the dynamic weight comprises:

setting the dynamic weight to a value proportional to the current sample value.

9. The method of claim 1, wherein the filtering the plurality of sample values comprises:

determining a current filtered value of the plurality of filtered values based on the dynamic weight, the current sample value, and a previous filtered value of the plurality of filtered values.

10. The method of claim 1, wherein the filtering the plurality of sample values comprises:

determining an i-th filtered value FilteredValue(i) of the plurality of filtered values (where i is an integer greater than 1) as $$FilteredValue(i) = \frac{\beta \times \text{sample}(i) + (\text{max_samples} - \beta) \times FilteredValue(i-1)}{\text{max_samples}}$$

where β represents the dynamic weight, sample(i) is an i-th sample value of the plurality of sample values, max_samples is a maximum number of sample values utilized in the filtering of the plurality of sample values, and FilteredValue(i−1) is an (i−1)-th filtered value of the of the plurality of filtered values.

11. The method of claim 1, wherein the power supply is electrically coupled to an LED light and is configured to control light intensity of the LED light based on the control signal.

12. A power supply controller coupled to a power supply, the power supply controller comprising:

a processor; and a processor memory local to the processor, wherein the processor memory has stored thereon instructions that, when executed by the processor, cause the processor to perform:

receiving a current sample value of a plurality of sample values corresponding to dimmer levels;

determining a dynamic weight based on the current sample value;

filtering the plurality of sample values based on the dynamic weight to generate a plurality of filtered values; and generating a control signal based on the filtered values for transmission to the power supply.

13. The power supply controller of claim 12, wherein the power supply is electrically coupled to an LED light and is configured to control light intensity of the LED light based on the control signal.

14. The power supply controller of claim 12, wherein the determining the dynamic weight comprises:

determining that the current sample value is greater than a threshold value; and in response, setting the dynamic weight to a high value.

15. The power supply controller of claim 12, wherein the determining the dynamic weight comprises:

determining that the current sample value is less than or equal to a threshold value; and in response, setting the dynamic weight to a low value.

16. The power supply controller of claim 12, wherein the determining the dynamic weight comprises:

setting the dynamic weight to a value proportional to the current sample value.

17. The power supply controller of claim 12, wherein the filtering the plurality of sample values comprises:

determining a current filtered value of the plurality of filtered values based on the dynamic weight, the current sample value, and a previous filtered value of the plurality of filtered values.

18. The power supply controller of claim 12, wherein the filtering the plurality of sample values comprises:

determining an i-th filtered value FilteredValue(i) of the plurality of filtered values (where i is an integer greater than 1) as $$FilteredValue(i) = \frac{\beta \times \text{sample}(i) + (\text{max_samples} - \beta) \times FilteredValue(i-1)}{\text{max_samples}}$$

where β represents the dynamic weight, sample(i) is an i-th sample value of the plurality of sample values, max_samples is a maximum number of sample values utilized in the filtering of the plurality of sample values, and FilteredValue(i−1) is an (i−1)-th filtered value of the of the plurality of filtered values.

19. The power supply controller of claim 12, wherein the filtering the plurality of sample values comprises:

determining a current filtered value of the plurality of filtered values based on the dynamic weight, the current sample value, and a previous filtered value of the plurality of filtered values.

20. The power supply controller of claim 12, wherein the power supply is configured to drive a light source based on the control signal.

* * * * *